US008555592B2

(12) United States Patent
Daudet et al.

(10) Patent No.: US 8,555,592 B2
(45) Date of Patent: Oct. 15, 2013

(54) STEEL STUD CLIP

(76) Inventors: Larry Randall Daudet, Brentwood, CA (US); Jin-Jie Lin, Livermore, CA (US); Timothy M. Stauffer, Hercules, CA (US); Frank X. Ding, Pleasanton, CA (US); Paul Howard Oellerich, Hayward, CA (US); Christopher S. Goodman, Tracy, CA (US)

( * ) Notice: Subject to any disclaimer, the term of this patent is extended or adjusted under 35 U.S.C. 154(b) by 0 days.

(21) Appl. No.: 13/073,997

(22) Filed: Mar. 28, 2011

(65) Prior Publication Data

US 2012/0247059 A1 Oct. 4, 2012

(51) Int. Cl.
*E04B 2/30* (2006.01)

(52) U.S. Cl.
USPC ..... 52/489.1

(58) Field of Classification Search
USPC ..... 52/489.1, 489.2, 698, 699, 700, 702, 52/703, 704, 705, 709, 710, 92.2
See application file for complete search history.

(56) References Cited

U.S. PATENT DOCUMENTS

| | | | | |
|---|---|---|---|---|
| 1,568,944 | A * | 1/1926 | Beebe | 52/285.3 |
| 1,729,935 | A | 10/1929 | Froehlich | |
| 2,065,529 | A | 12/1936 | Kehr et al. | |
| 2,218,426 | A | 10/1940 | Hurlbert, Jr. | |
| 2,365,478 | A | 12/1944 | Grotta | |
| 3,003,600 | A | 10/1961 | MacKenzie | |
| 3,038,568 | A | 6/1962 | Morgan | |
| 3,321,880 | A | 5/1967 | Ferrell et al. | |
| 3,490,797 | A | 1/1970 | Platte | |
| 3,537,219 | A | 11/1970 | Navarre | |
| 3,715,850 | A | 2/1973 | Chambers | |
| 3,798,865 | A | 3/1974 | Curtis | |
| 3,805,465 | A | 4/1974 | Dietrich | |
| 3,972,168 | A | 8/1976 | Allen | |
| 4,067,168 | A * | 1/1978 | Thurner | 52/854 |
| 4,121,391 | A | 10/1978 | Schroeder | |
| 4,140,294 | A | 2/1979 | Zwarts | |
| 4,433,524 | A | 2/1984 | Matson | |
| 4,570,400 | A | 2/1986 | Slager et al. | |
| 4,796,403 | A | 1/1989 | Fulton et al. | |
| 4,819,401 | A | 4/1989 | Whitney, Jr. | |
| 4,843,776 | A | 7/1989 | Guignard | |
| 4,949,929 | A | 8/1990 | Kesselman et al. | |
| 5,027,494 | A | 7/1991 | Martin | |
| 5,113,631 | A | 5/1992 | diGirolamo | |
| 5,127,760 | A | 7/1992 | Brady | |
| 5,216,858 | A | 6/1993 | Gilmour | |
| 5,265,396 | A | 11/1993 | Amimoto | |

(Continued)

FOREIGN PATENT DOCUMENTS

WO WO-96/31667 A1 10/1996

OTHER PUBLICATIONS

Schafer, B.W., et al., "Accommodating Building Deflections: What every EOR should know about accommodating deflections in secondary cold-formed steel systems." NCSEA/CASE/SEI, STRUCTURE Magazine, Apr. 2003, Chicago.

(Continued)

*Primary Examiner* — Mark Wendell
*Assistant Examiner* — Keith Minter
(74) *Attorney, Agent, or Firm* — James R. Cypher; Charles R. Cypher

(57) ABSTRACT

An improved connection between supporting and supported structural members, particularly between the sheathing and framing members of curtain walls.

22 Claims, 14 Drawing Sheets

(56) References Cited

U.S. PATENT DOCUMENTS

| | | | | |
|---|---|---|---|---|
| 5,313,752 | A | 5/1994 | Hatzinikolas | |
| 5,323,577 | A | 6/1994 | Whitmyer | |
| 5,335,469 | A * | 8/1994 | Stuart | 52/655.1 |
| 5,402,612 | A | 4/1995 | diGirolamo | |
| 5,467,566 | A | 11/1995 | Swartz et al. | |
| 5,471,805 | A | 12/1995 | Becker | |
| 5,572,844 | A | 11/1996 | Stackenwalt et al. | |
| 5,577,860 | A | 11/1996 | Plank | |
| 5,640,823 | A | 6/1997 | Bergeron et al. | |
| 5,664,392 | A * | 9/1997 | Mucha | 52/715 |
| 5,671,580 | A | 9/1997 | Chou | |
| 5,689,922 | A | 11/1997 | Daudet | |
| 5,720,571 | A * | 2/1998 | Frobosilo et al. | 403/403 |
| 5,755,066 | A | 5/1998 | Becker | |
| 5,846,018 | A * | 12/1998 | Frobosilo et al. | 403/403 |
| 5,876,006 | A | 3/1999 | Sharp et al. | |
| 5,904,023 | A | 5/1999 | diGirolamo et al. | |
| 5,906,080 | A * | 5/1999 | diGirolamo et al. | 52/243.1 |
| 5,913,788 | A | 6/1999 | Herren | |
| 5,937,605 | A | 8/1999 | Wendt | |
| 5,983,589 | A | 11/1999 | Daudet | |
| 6,058,668 | A | 5/2000 | Herren | |
| 6,088,982 | A | 7/2000 | Hiesberger | |
| 6,199,929 | B1 | 3/2001 | Hansch | |
| 6,213,679 | B1 * | 4/2001 | Frobosilo et al. | 403/403 |
| 6,301,854 | B1 | 10/2001 | Daudet et al. | |
| 6,430,890 | B1 | 8/2002 | Chiwhane et al. | |
| D467,007 | S | 12/2002 | Daudet et al. | |
| 6,591,562 | B2 | 7/2003 | Ting | |
| 6,598,361 | B2 | 7/2003 | Ting | |
| 6,612,087 | B2 | 9/2003 | diGirolamo et al. | |
| 6,668,510 | B2 | 12/2003 | McManus | |
| 6,688,069 | B2 * | 2/2004 | Zadeh | 52/715 |
| 6,691,482 | B1 | 2/2004 | Ault | |
| 6,701,689 | B2 | 3/2004 | diGirolamo | |
| 6,719,481 | B2 | 4/2004 | Hoffmann | |
| 6,748,705 | B2 | 6/2004 | Orszulak et al. | |
| 6,792,733 | B2 | 9/2004 | Wheeler et al. | |
| 6,799,407 | B2 | 10/2004 | Saldana | |
| 6,843,035 | B1 | 1/2005 | Glynn | |
| 6,854,237 | B2 | 2/2005 | Surowiecki | |
| 6,871,470 | B1 | 3/2005 | Stover | |
| 7,104,024 | B1 | 9/2006 | diGirolamo et al. | |
| RE39,462 | E | 1/2007 | Brady | |
| 7,174,690 | B2 * | 2/2007 | Zadeh | 52/715 |
| 7,225,590 | B1 | 6/2007 | diGirolamo et al. | |
| 7,293,393 | B2 | 11/2007 | Kelly et al. | |
| 7,299,593 | B1 | 11/2007 | diGirolamo et al. | |
| 7,367,168 | B2 * | 5/2008 | Lin | 52/702 |
| 7,451,573 | B2 | 11/2008 | Orszulak et al. | |
| 7,478,508 | B2 | 1/2009 | Peterson | |
| 7,503,150 | B1 | 3/2009 | diGirolamo et al. | |
| 7,520,100 | B1 | 4/2009 | Herrman et al. | |
| 7,533,508 | B1 * | 5/2009 | diGirolamo et al. | 52/481.1 |
| 7,559,519 | B1 | 7/2009 | Dragic et al. | |
| 7,596,921 | B1 | 10/2009 | diGirolamo et al. | |
| 7,617,643 | B2 | 11/2009 | Pilz et al. | |
| 7,634,889 | B1 | 12/2009 | diGirolamo et al. | |
| 7,640,701 | B2 | 1/2010 | Rutherford | |
| 7,644,549 | B2 | 1/2010 | Speck | |
| 7,658,356 | B1 * | 2/2010 | Nehls | 248/300 |
| 7,681,365 | B2 | 3/2010 | Klein | |
| 7,716,899 | B2 | 5/2010 | Beck et al. | |
| 7,735,295 | B2 | 6/2010 | Surowiecki | |
| 7,739,850 | B2 | 6/2010 | Daudet | |
| 7,752,817 | B2 | 7/2010 | Pilz et al. | |
| 7,788,878 | B1 | 9/2010 | diGirolamo et al. | |
| 7,856,763 | B2 * | 12/2010 | Keys et al. | 52/92.2 |
| 7,987,636 | B2 * | 8/2011 | Hunt | 52/92.2 |
| D644,503 | S | 9/2011 | Crane et al. | |
| 8,091,316 | B2 | 1/2012 | Beck et al. | |
| 8,181,419 | B1 | 5/2012 | digirolamo | |
| 2005/0086905 | A1 | 4/2005 | Ralph et al. | |
| 2006/0096192 | A1 * | 5/2006 | Daudet | 52/204.1 |
| 2010/0011697 | A1 * | 1/2010 | Nguyen et al. | 52/714 |
| 2010/0126103 | A1 | 5/2010 | diGirolamo | |
| 2011/0107710 | A1 * | 5/2011 | Sias | 52/655.1 |

OTHER PUBLICATIONS

"International Search Report and The Written Opinion of the International Searching Authority," PCT/US2012/030963, Jul. 30, 2012, 6 pages.

"Curtainwall Deflection Solutions," Super Stud Building Products, Inc. Product Catalog, 2001, 24 pages including front cover. Super Stud Building Products, Inc., Edison.

"Redi Klip Submittal: Head-of-Wall Positive Attachment Deflection Clip," Total Steel Solution, as early as May 22, 2013, 2 pages, USA.

"Posi Klip Product Information: Head-of-Wall Positive Attachment Deflection Clip," FireTrak Corporation, as early as May 22, 2013, 1 page, USA.

"Sliptrack Systems: Slotted Deflections Track Systems for Interior and Exterior Walls," SlipTrack Systems, 2003, 6 pages. Dietrich Metal Framing: A Worthington Industries Company, USA.

"TSN Products: Steel framing products," The Steel Network TSN website, 2010, 2 pages. The Steel Network, Inc., USA.

"TSN Product: VertiClip® SLB," the Steel Network TSN website, Dec. 26, 2012, 2 pages, The Steel Network, Inc., USA.

"Priceless Steel Products Clip Central," Priceless Steel Products Website, Aug. 30, 2010, 2 pages. Scafco Steel Stud Manufacturing Co., WA.

"Bypass Slab Slip Clip: PLC2," Priceless Steel Product Catalog, as early as May 22, 2013, p. 12-13. Scafco Steel Stud Manufacturing Co., WA.

"SLP-TRK® Slotted Track (BDTK)," "Head of Wall," SlipTrack Systems, as early as Jul. 2010, p. 26-29. Dietrich Metal Framing: A Worthington Industries Company, USA.

"Curtainwall Deflection Solutions," Buy Super Stud Website, Aug. 2010, 2 pages. Super Stud Building Products, Inc., Edison.

"Curtain Wall Systems", "Jam Stud Introduction", "Design Considerations", "Header/Sill Solutions", "Connections", "VertiClip: Vertical Deflection Connectors", "DriftClip and DriftTrk: Vertical Deflection and Lateral Drift", "Bridging", "Design Software," TSN The Steel Network Product Catalog, May 2009, cover page, p. 1, 4,18, 30-33, 35, 36, back cover. The Steel Network, Inc., USA.

* cited by examiner

STEEL STUD CLIP

BACKGROUND OF THE INVENTION

The present invention belongs to a class of stud mounting clips that are useful in the construction of buildings, particularly light commercial buildings.

Many buildings are constructed with steel stud wall systems in order to achieve reduced environmental concerns, fire safety and reduced susceptibility to warpage, infestation, rust and rot. For a variety of reasons, it is often advantageous to construct these walls systems with connectors that permit a degree of relative movement between the framing members. Buildings often settle on their foundations once constructed, which can cause exterior walls to go out of plumb, in turn causing damage to the surrounding foundation and to interior structures such as floors. Exterior walls and frames, particularly of light commercial buildings, are often made from materials that have different coefficients of expansion than that of the structure's exterior sheathing. With exposure to extremes of temperature, gaps can be produced in the exterior sheathing panels if they expand or contract more than the framing, allowing cold air and moisture to intrude. Exterior walls of buildings are also subject to deflection from wind or seismic forces, and a degree of freedom of movement can reduce stress and prevent fracture of connected parts. And curtain walls (e.g., partition walls) are not designed to support vertical loads and must therefore by isolated from deflection of the primary load-bearing support structure of the building due to changes in live or dead loads carried by that structure.

A variety of slide, or slip, clips that permit relative movement between structural members have been made, but none have successfully optimized the use of material in the clips and the loads achieved by the clips. The slip clip connector of the present invention has been designed to achieve the maximum possible loads from the minimum amount of material, thereby realizing substantial savings, in cost as well as material, over the prior art.

The present invention also encompasses clips that include the same improvements to maximize load and minimize material use, but do not permit slip between members.

BRIEF SUMMARY OF THE INVENTION

A first aspect of the invention relates to an angled connector with rolled edge flanges that has a unique fastener geometry in one plate and reinforcing embossments in the other to more optimally distribute loads among fasteners and thereby achieve higher tension loads while using the smallest possible number of fasteners and the lightest possible material for the connector.

A second aspect of the invention relates to an angled connector with rolled edge flanges and slotted fastener openings that also have rolled edges, reinforcing the slotted fastener openings, stiffening the connector plate, and reducing unnecessary friction between the connector plate and the structural member to which it is attached.

The connectors of the present invention can be made from lighter-gauge materials than the prior art connectors of the same type, but the connectors of the present invention equal or exceed the same prior art connectors in performance. The preferred material for the connectors of the present invention is 16-gauge Grade 40 hot-dip galvanized G90 sheet steel. The ability to go down one or even two gauges results in substantial savings not only in the cost of sheet steel, but also in storage and transportation costs, both of which are reduced when the connectors are lighter and thinner than the prior art.

The specific improvements of the present invention were only possible due to careful consideration and calculation using finite element analysis to ensure that loads are transferred inward from the roll-stiffened edges and distributed among the fasteners to maximize the strength of the connection.

DETAILED DESCRIPTION OF THE INVENTION

Figure 1A:
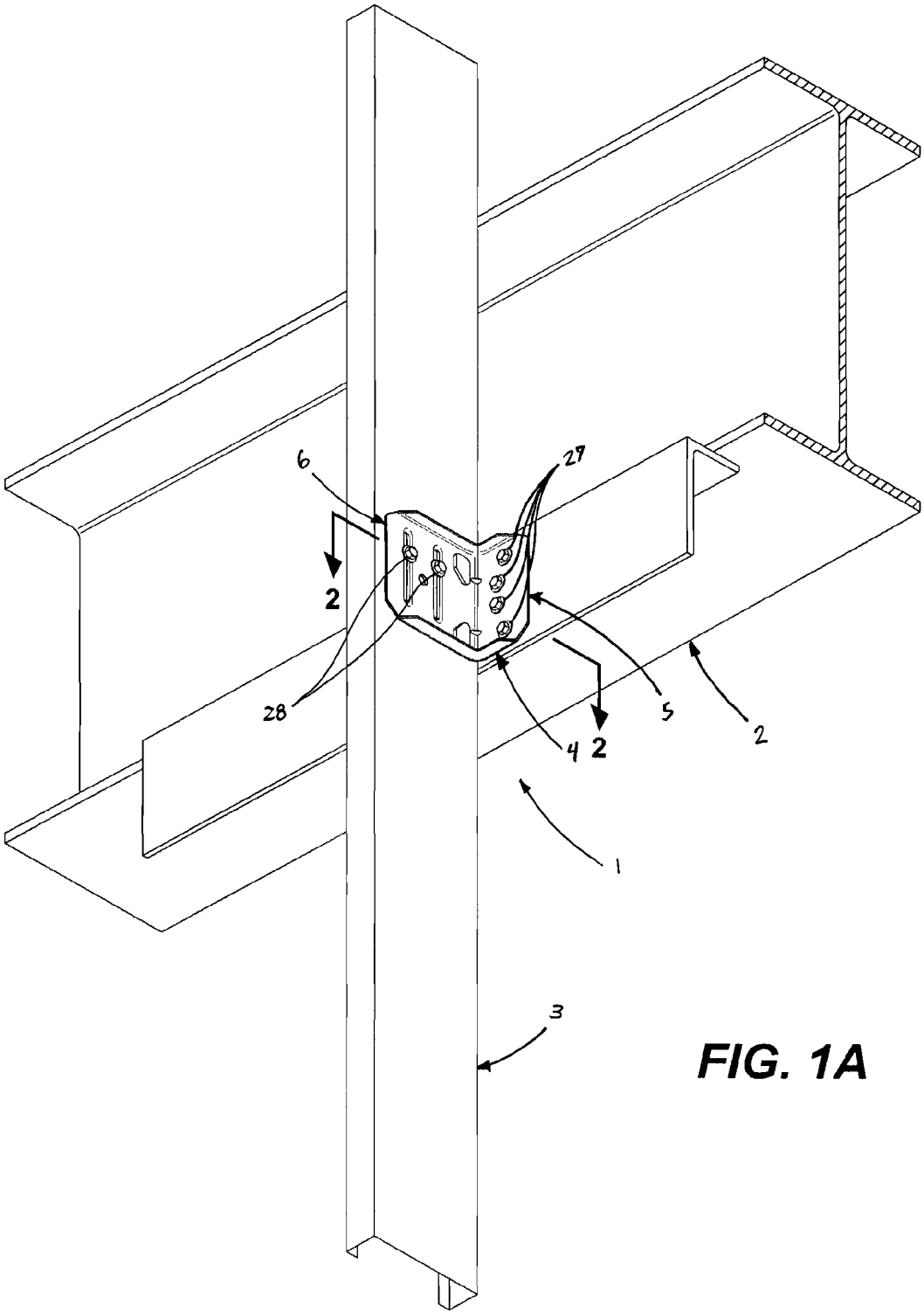
FIG. 1A is a perspective view of a wall stud-to-beam connection formed according to the present invention.
Figure 5A:
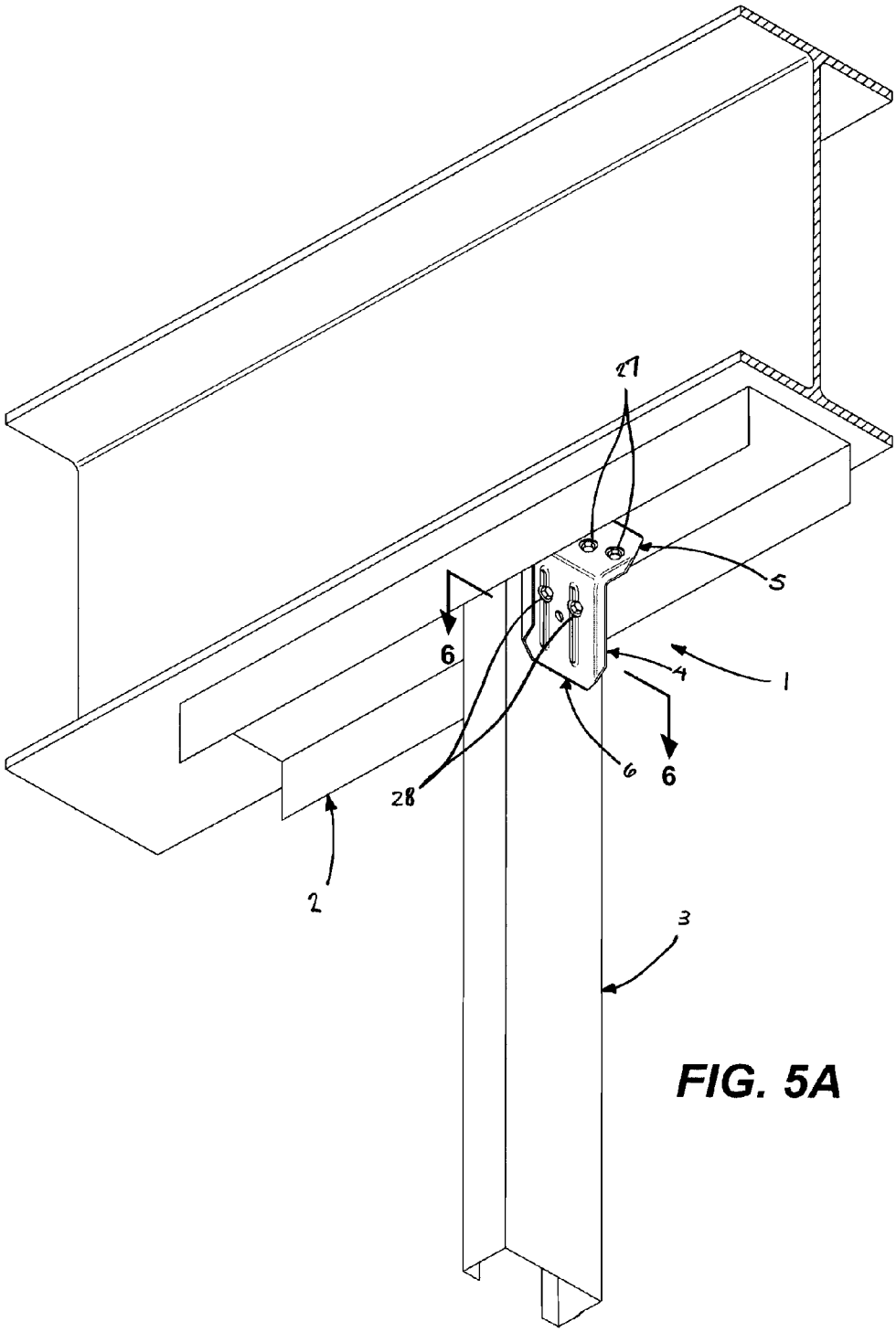
FIG. 5A is a perspective view of a wall stud-to-top plate connection formed according to the present invention.
Figure 5B:
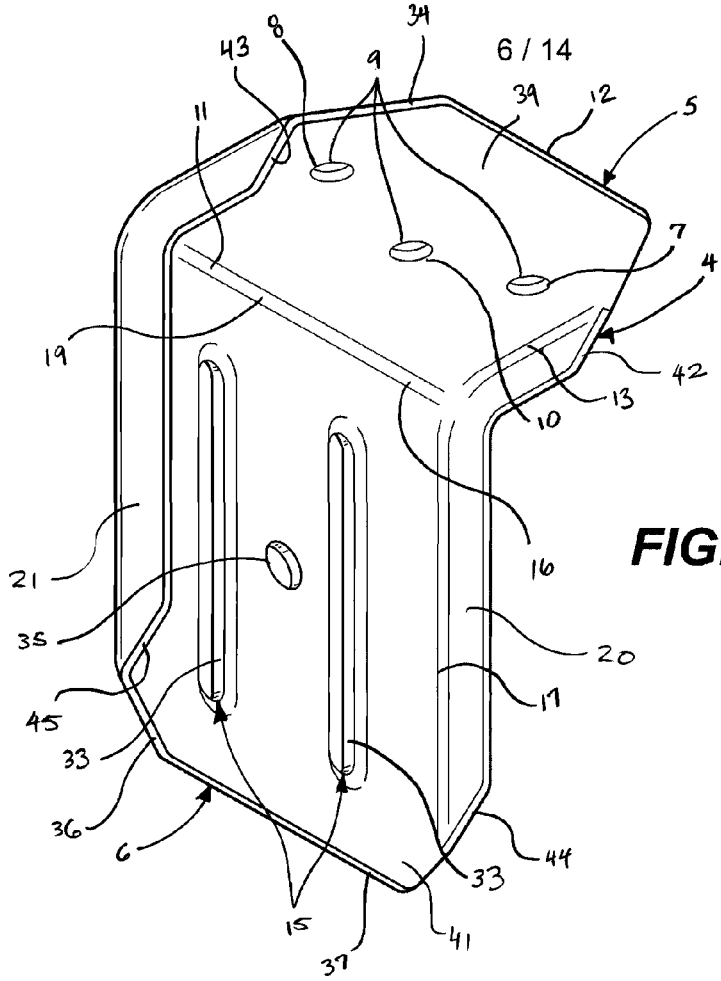
FIG. 5B is a perspective view of a connector formed according to the present invention.
Figure 6:
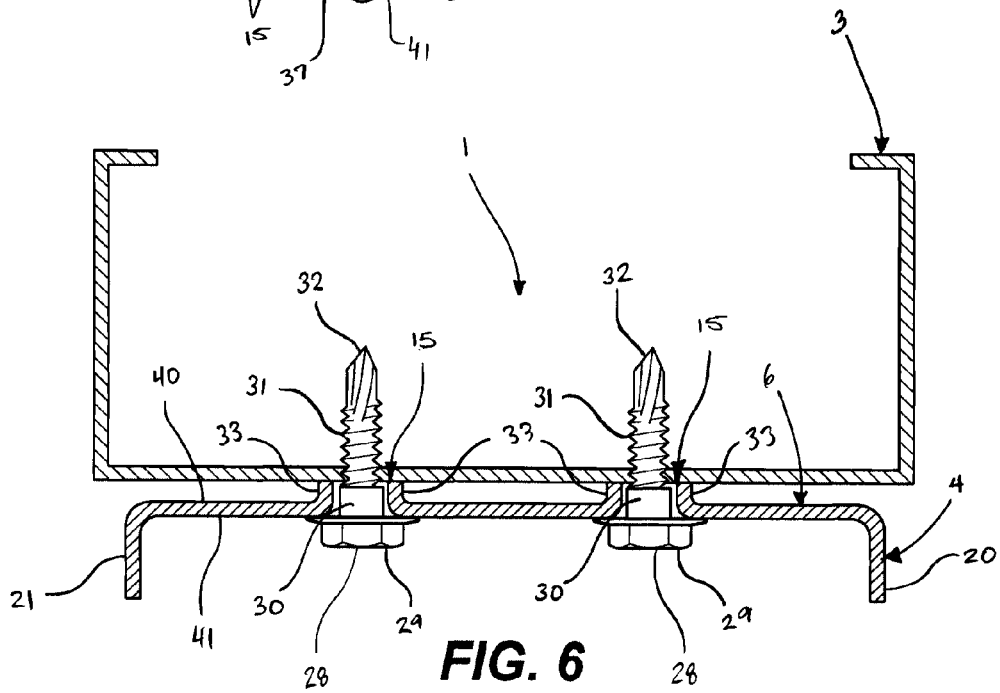
FIG. 6 is a cross-sectional cutaway view taken along view line 6-6 of the connection shown in FIG. 5A.
Figure 7A:
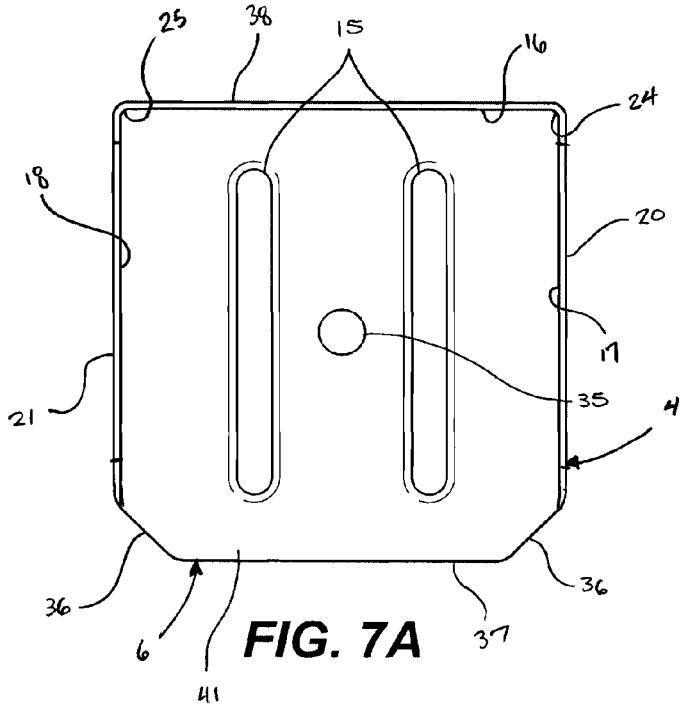
FIG. 7A is a front elevation view of a connector formed according to the present invention.
Figure 7B:
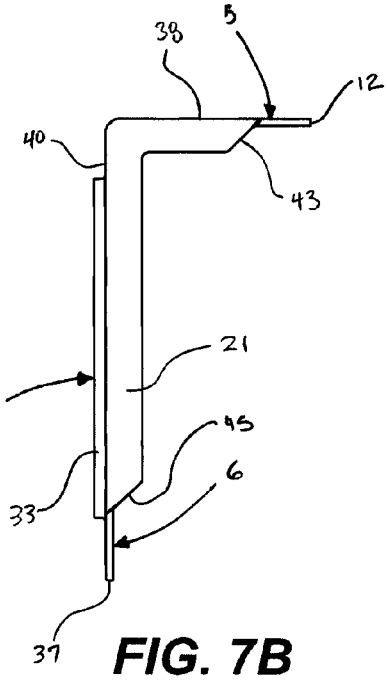
FIG. 7B is a side elevation view of a connector formed according to the present invention.
Figure 7C:
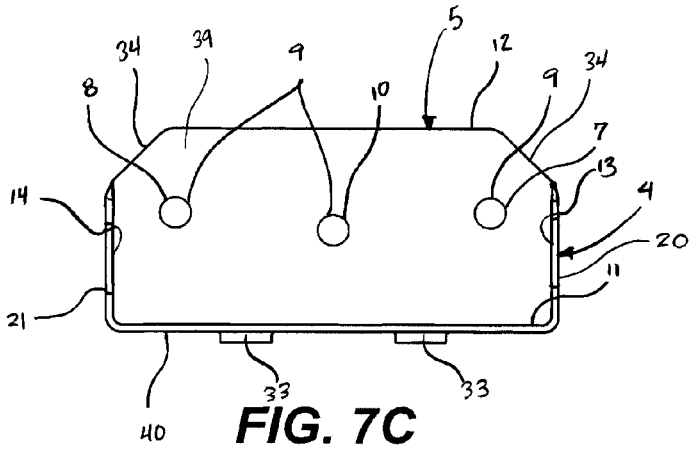
FIG. 7C is a bottom plan view of a connector formed according to the present invention.
Figure 8A:
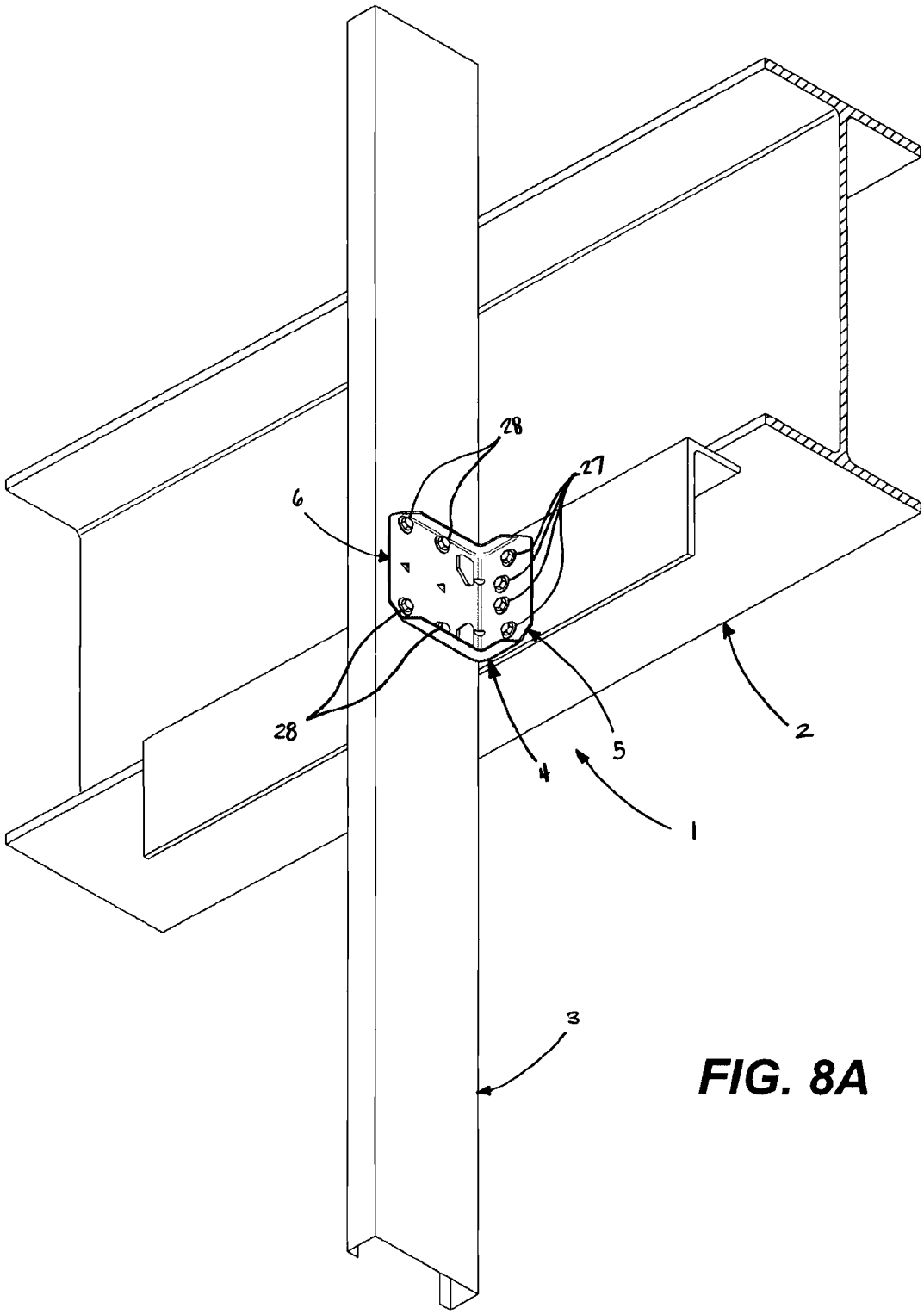
FIG. 8A is a perspective view of a connection formed according to the present invention.
Figure 8B:
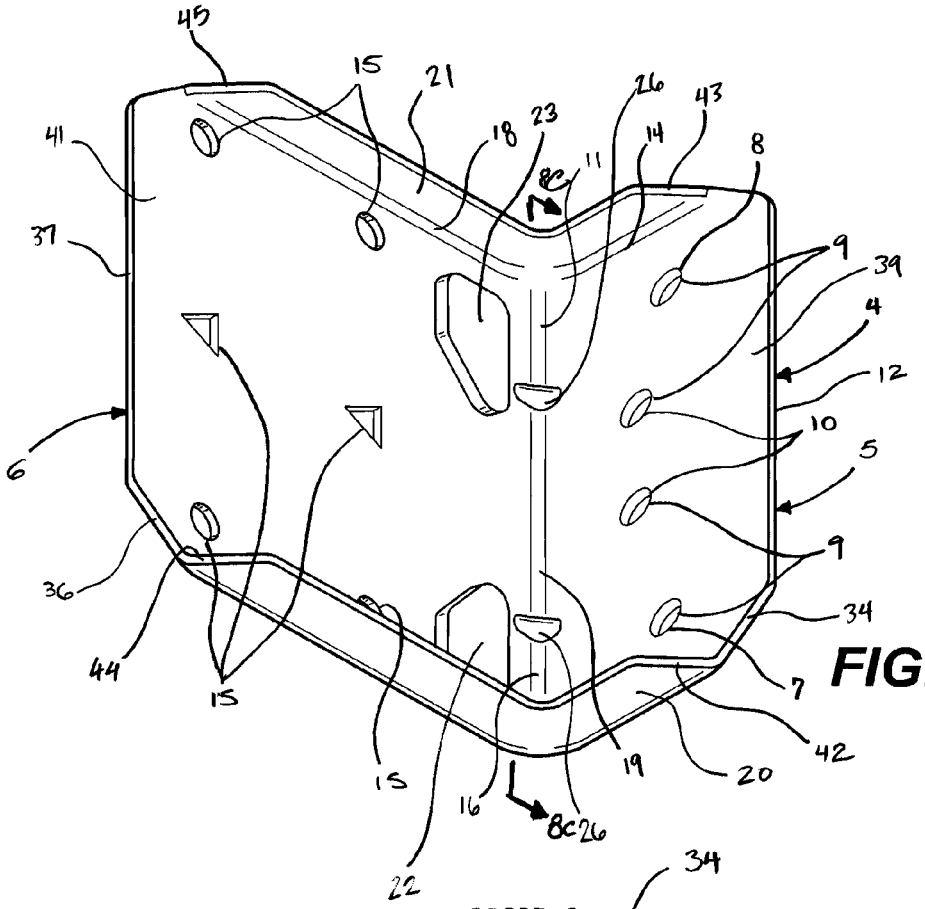
FIG. 8B is a perspective view of a connector formed according to the present invention.
Figure 11A:
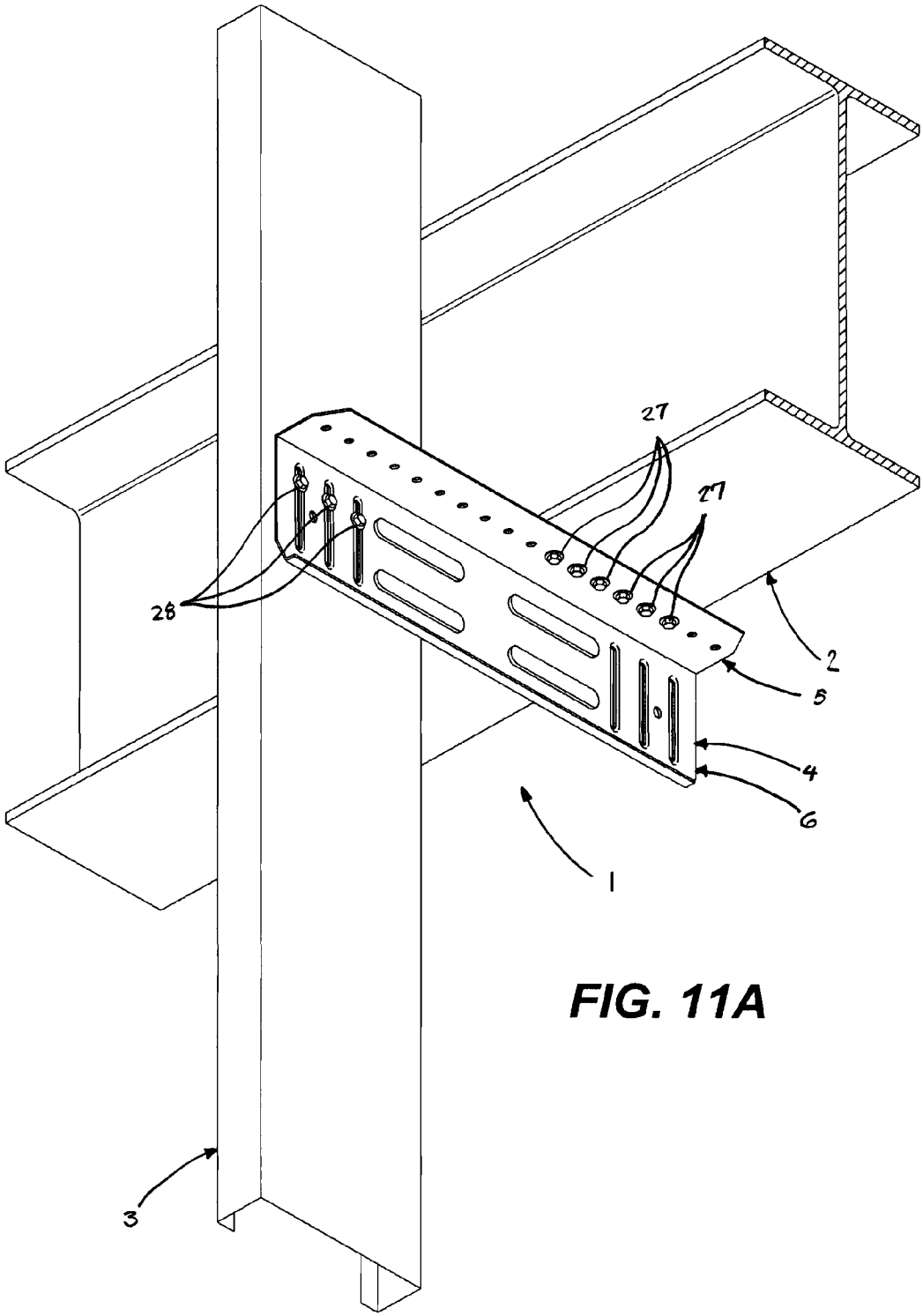
FIG. 11A is a perspective view of a wall stud-to-beam connection formed according to the present invention.
Figure 11B:
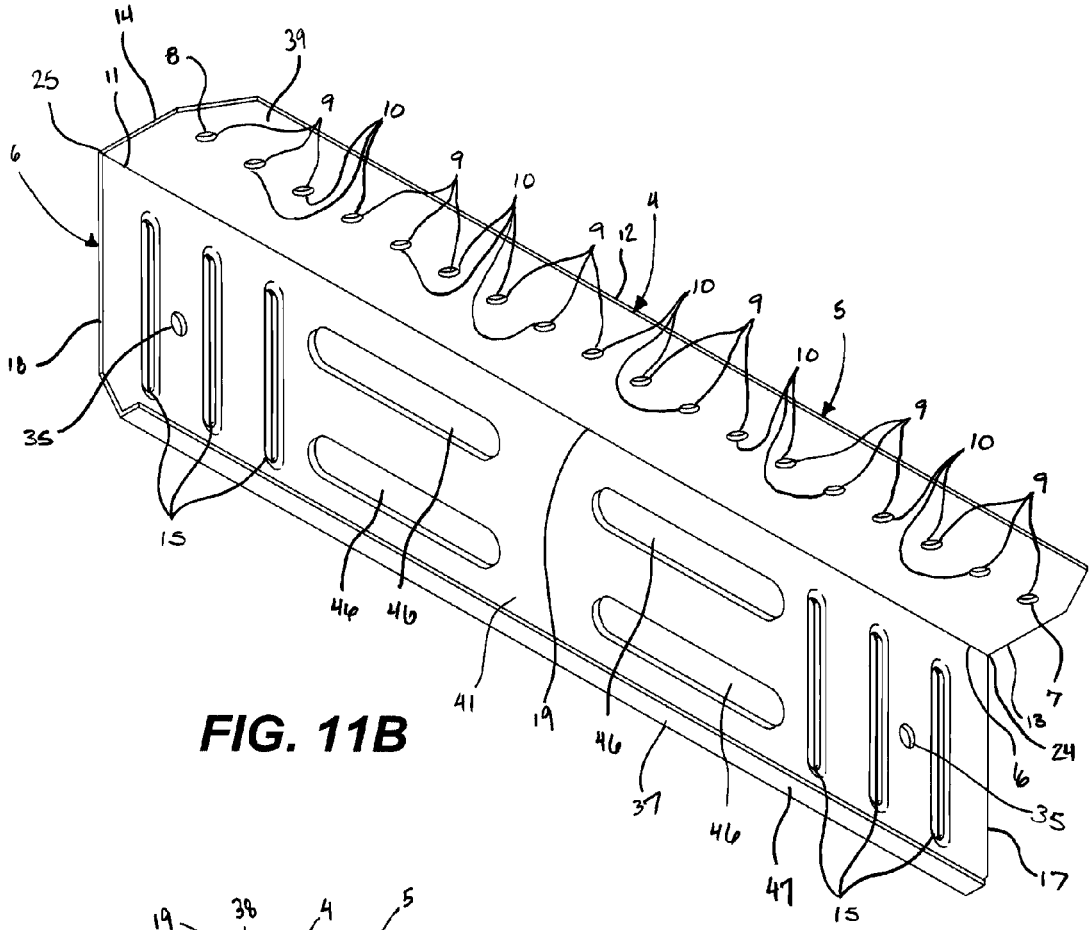
FIG. 11B is a perspective view of a connector formed according to the present invention.
Figure 12C:
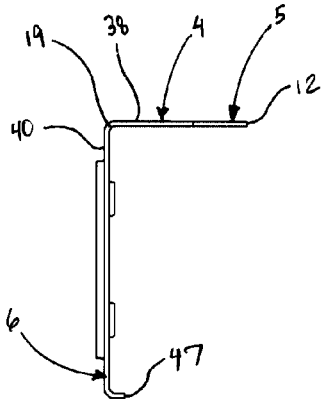
FIG. 12C is a side elevation view of a connector formed according to the present invention.
Figures 12A, 12B, 12D:
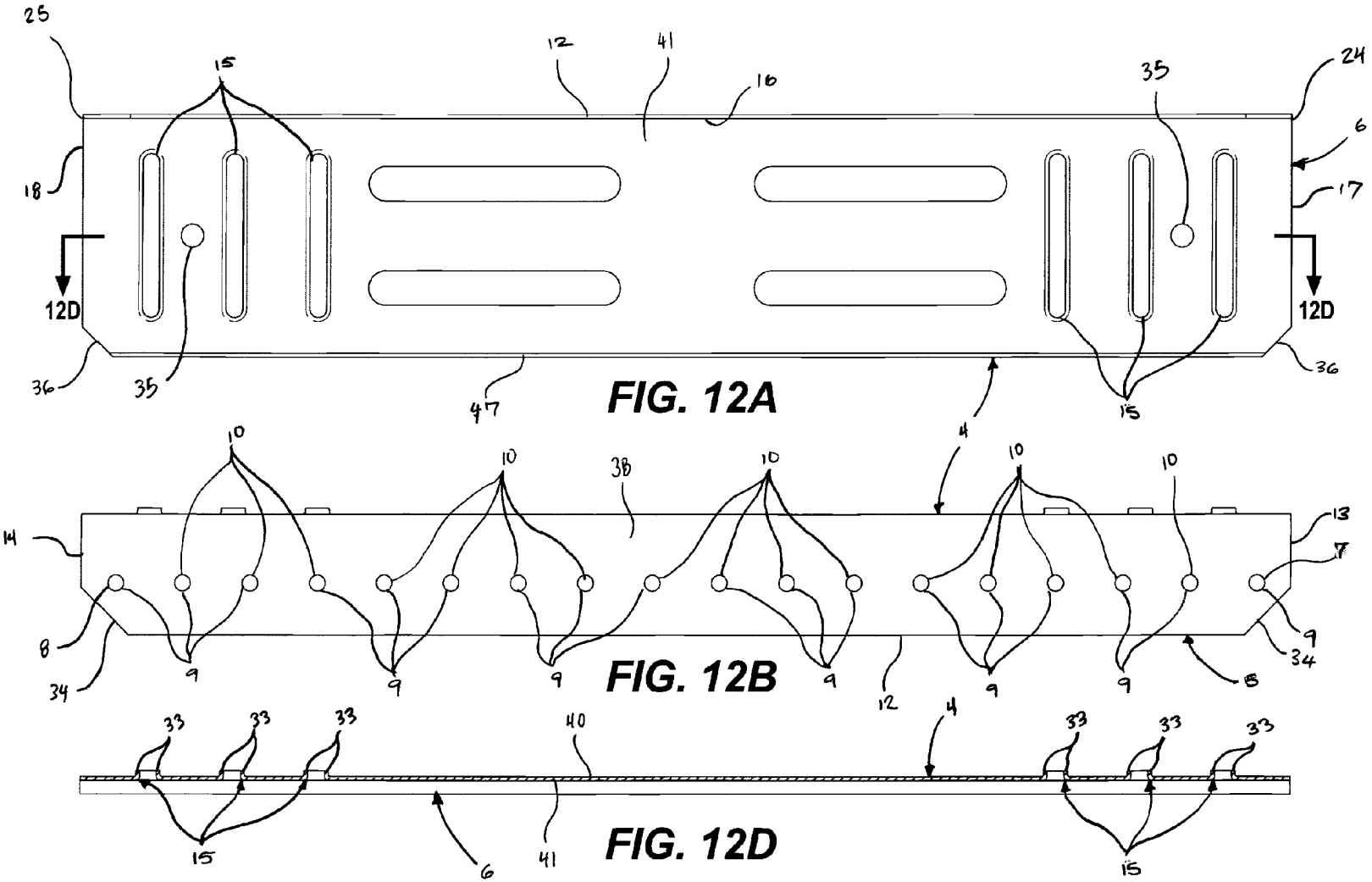
FIG. 12A is a front elevation view of a connector formed according to the present invention.
FIG. 12B is a bottom plan view of a connector formed according to the present invention.
FIG. 12D is a cross-sectional cutaway view taken along view line 12D-12D of the connector shown in FIG. 12A.

The present invention is a building structural connection 1 between a first building structural member 2 and a second building structural member 3. Preferably, the first building structural member 2 is a supporting member 2 and the second building structural member 3 is a supported structural member 3. As shown in FIGS. 1A and 8A, the first building structural member 2 is a horizontal beam with an attached ledger 2 and the second building structural member 3 is a vertically-oriented channel-shaped wall post 3. As shown in FIG. 5A, the first building structural member 2 is a horizontal beam with an attached vertically-oriented channel-shaped header 2—the second building structural member 3 is a vertically-oriented channel-shaped wall post 3. As shown in FIG. 11A, the first building structural member 2 is a horizontal beam 2 and the second building structural member 3 is a vertically-oriented channel-shaped wall post 3.

The connection 1 between the first building structural member 2 and the second building structural member 3 is made with a first connector 4. The first connector 4 is preferably L-shaped, with a first plate 5 fastened to the first building structural member 2 and a second plate 6 fastened to the second building structural member 3. Preferably, said first plate 5 and said second plate 6 are generally planar and joined at right angles to each other. In the most common embodiments, the connector 4 allows for relative vertical movement between the first and second building structural members 2 and 3. A simple 90-degree change in orientation would allow the connector 4 to permit relative horizontal movement. The connector 4 is preferably made from 16-gauge cold formed sheet steel, bent, cut, embossed and punched on automated manufacturing machinery. Preferably, the connector 4 is used to connect cold formed steel structural members.

Figure 1B:
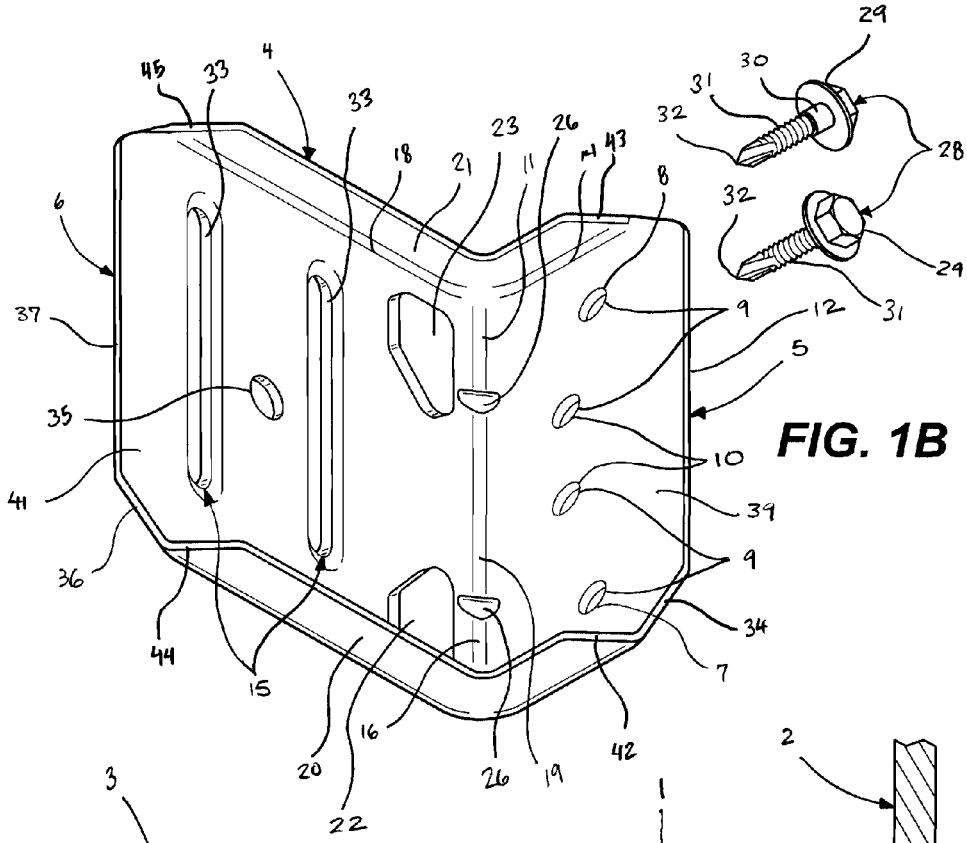
FIG. 1B is a perspective view of a connector formed according to the present invention.
Figure 2:
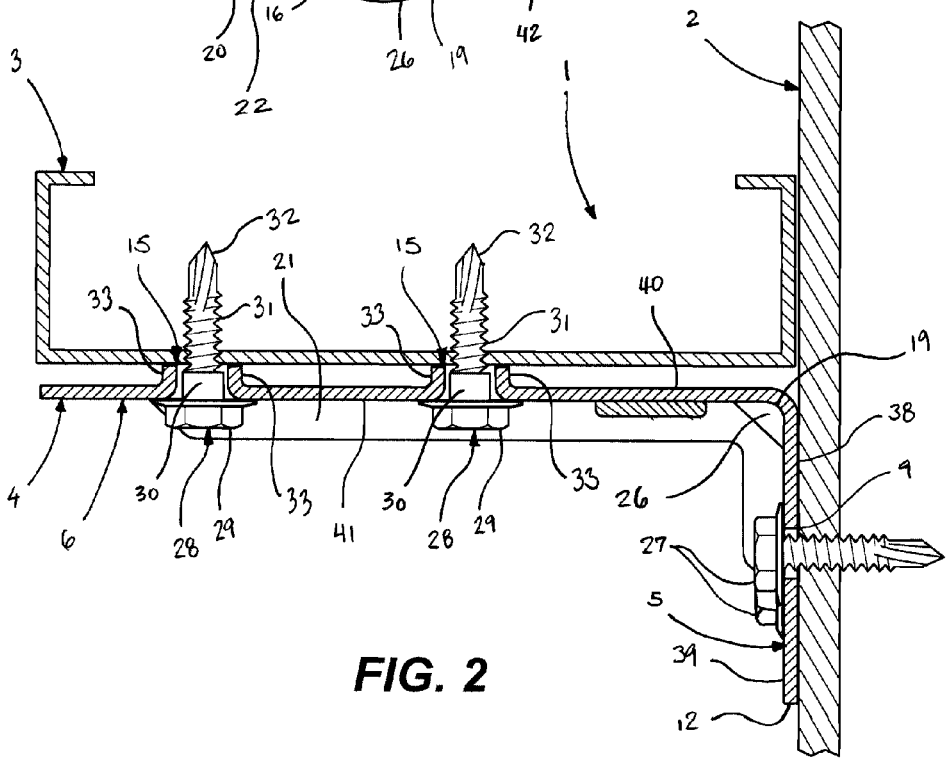
FIG. 2 is a cross-sectional cutaway view taken along view line 2-2 of the connection shown in FIG. 1A.

As shown in FIG. 1B, the first plate 5 has first and second fastener openings 7 and 8 of a first plurality of fastener openings 9 that includes one or more additional fastener openings 10 in addition to said first and second fastener openings 7 and 8.

The first plate 5 has a first inner edge 11, a first outer edge 12, a first side edge 13 and a second side edge 14.

Figure 3A:
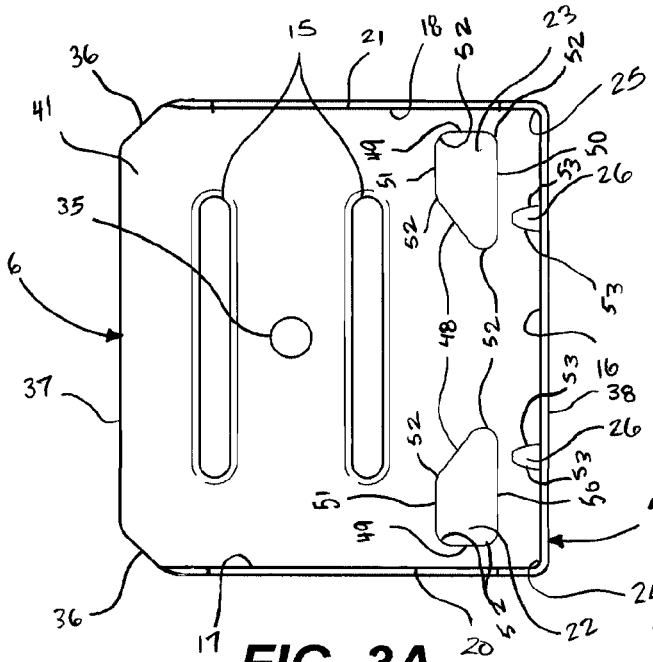
FIG. 3A is a front elevation view of a connector formed according to the present invention.
Figure 3C:
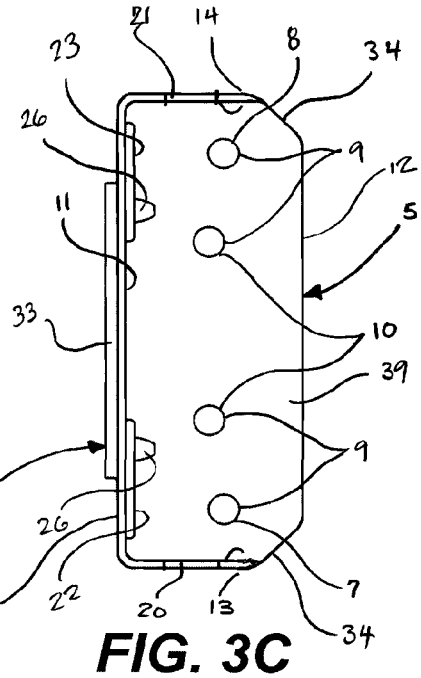
FIG. 3C is a top plan view of a connector formed according to the present invention.
Figure 3B:
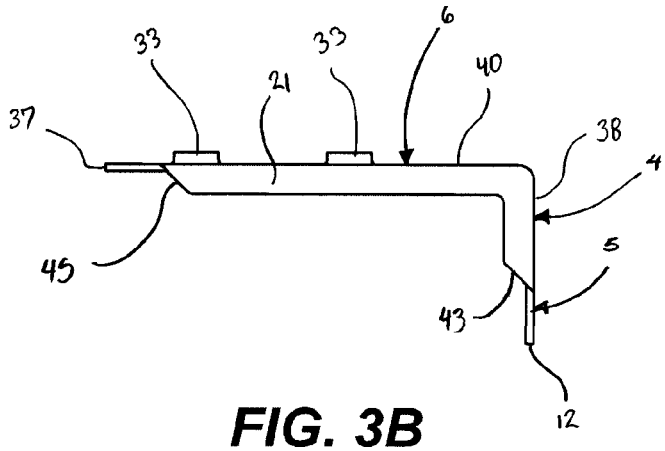
FIG. 3B is a side elevation view of a connector formed according to the present invention.

As shown in FIG. 3C, the first fastener opening 7 is the closest of the first plurality of fastener openings 9 to the first side edge 13. The second fastener opening 8 is the closest of the first plurality of fastener openings 9 to the second side edge 14. The first and second fastener openings 7 and 8 are closer to the first outer edge 12 than the one or more additional fastener openings 10. The one or more additional fastener openings 10 are closer to the first inner edge 11 than the first and second fastener openings 7 and 8.

As shown in FIG. 3A, the second plate 6 has a second plurality of fastener openings 15, a first inner edge 16, a first side edge 17 and a second side edge 18. The first side edge 17 of the second plate 6 intersects the first inner edge 16 at a first corner juncture 24. The second side edge 17 of the second plate 6 intersects the first inner edge 16 at a second corner juncture 25.

The first inner edge 11 of the first plate 5 is joined to the first inner edge 16 of the second plate 6 to form an inner angular juncture 19. Preferably the inner angular juncture 19 is 90 degrees.

As shown in FIG. 1B, a first reinforcing flange 20 is attached to the first side edge 13 of the first plate 5 and to the first side edge 16 of the second plate 6. A second reinforcing flange 21 is attached to the second side edge 14 of the first plate 5 and to the second side edge 18 of the second plate 6. The first and second reinforcing flanges 20 and 21 are continuous, with no breaks at the juncture 19 between the first plate 5 and the second plate 6.

As shown in FIG. 3A, the connector 4 includes a first embossment 22 in the second plate 6. The first embossment 22 is located between the second plurality of fastener openings 15 and the first inner edge 16 of the second plate 6. The first embossment 22 reinforces the second plate 6 and is adjacent said first corner juncture 24.

The connector 4 also includes a second embossment 23 in the second plate 6. The second embossment 23 is located between the second plurality of fastener openings 15 and the first inner edge 16 of the second plate 6. The second embossment 23 reinforces the second plate 6 and is adjacent the second corner juncture 25.

The unique, staggered distribution of the first plurality of fastener openings 9 distributes load evenly among the fasteners 9, while the first and second embossments 22 and 23 distribute loads in the second plate 6, allowing the connector 4 of the present invention to be made from 16 gauge sheet metal while analogous connectors have to be made from 14 or even 12 gauge sheet metal, which is substantially more expensive to manufacture and transport, adding cost and waste at every stage. This distribution of fastener openings 9 is not found in any other slide, or slip, clip.

As shown in FIGS. 1A-3A, 3C-4A, 4C, 8A-9A, and 9C-10C, preferably the first connector 4 has one or more gusset darts 26 in the inner angular juncture 19 that reinforce the inner angular juncture 19.

Preferably, a first plurality of fasteners 27 attaches the first plate 5 to the first building structural member 2. A second plurality of fasteners 28 preferably attaches the second plate 6 to the second building structural member 3.

Preferably, the fasteners 28 of the second plurality of fasteners 28 are screws 28. The preferred fasteners 27 for attaching the connector 4 to first structural members 2 made from steel are #12 or #14 hex-head fasteners 27, automated power-actuated gun-driven fasteners 27 or, alternatively, welds 27. The preferred fasteners 27 for attaching the connector 4 to first structural members 2 made from concrete are concrete screws 27. The preferred fasteners 28 for attaching the connector 4 through slots 15 are shouldered, or stepped-shank, screws 28.

As shown in FIGS. 1A-1B, 3A, 4A, 5A-5B, 7A, 11A-11B and 12A, the second plurality of fastener openings 15 is preferably formed as a plurality of elongated slots 15 in the second plate 6 when movement between the structural member 2 or 3 and the connector 4 is desired.

Preferably, the first building structural member 2 is fastened to the first connector 4 so that the first building structural member 2 cannot move relative the first plate 5 of the first connector 4.

The second building structural member 3 is preferably fastened to the first connector 4 so that the second building structural member 3 can move relative to the second plate 6 of the first connector 4.

Preferably, the fasteners of the second plurality of fasteners 28 are shouldered, or stepped-shank screws 28. Shouldered screws 28 have a head 29, an unthreaded shank portion 30 immediately below the head 29, a threaded shank portion 31 below the unthreaded shank portion 30, and a tip 32. The unthreaded shank portion 30 allows the second building structural member 3 and the fasteners 28 attached to it to move relative to the second plate 6 without interference between the second plurality of fastener 28 and the second plate 6 of the first connector 4.

As shown in FIGS. 1A-7C and 11A-12D, the elongated slots 15 preferably have rolled edges 33 that stiffen the elongated slots 15 and reinforce the second plate 6. The rolled edges 33 also reduce friction between the second plate 6 and the second building structural member 3 by reducing the surface contact between the second plate 6 and the second building structural member 3.

As shown in FIGS. 1A-3C, in a preferred embodiment, the connector 4 of the present invention has four fastener openings 9 in the first plate 5, which is fixedly attached to the first building structural member 2. The two outer corners 34 of the first plate 5 are chamfered to save material and make the connector 4 easier and safer to handle. A first fastener opening 7 is near the first outer corner 34 and a second fastener opening 8 is near the second outer corner 34. The two additional fastener openings 10 are between the first fastener opening 7 and the second fastener opening 8 and are closer to the inner angular juncture 19 between the first plate 5 and the second plate 6. The connector 4 also has first and second embossments 22 and 23 in the second plate 6. The embossments are trapezoidal. The first embossment 22 is near the first corner juncture 24 of the second plate 6 and the second embossment 23 is near the second corner juncture 25 of the second plate 6. The second plate 6 has two elongated slot openings 15 that extend across the second plate 6 generally parallel to the inner angular juncture 19 between the first plate 5 and the second plate 6. The slots 15 have rolled edges 33 that reinforce the slots 15 and stiffen the second plate 6. The rolled edges 33 are rolled down to project slightly from the attachment side 40 of the second plate 6, which has an open side 41 facing in the opposite direction. The attachment side 40 of the second plate 6 faces the second building structural member 3. Similarly, the first plate 5 has an attachment side 38 and an open side 39 facing in the opposite direction. The attachment side 38 of the first plate 5 faces the first building structural member 2. There is a single round pilot hole 35 halfway between the slots 15 and midway between the first and second side edges 17 and 18 of the second plate 6. As with the first plate 5, the outer corners 36 of the second plate 6 are chamfered. A first outer edge 37 of the second plate 6 runs from corner 36 to corner 36. The first end 42 of the first reinforcing flange 20, and the first end 43 of the second reinforcing flange 21, both projecting from the first plate 5, are angled to match the chamfered outer corners 34 of the first plate 5. Similarly, the second end 44 of the first reinforcing flange 20, and the second end 45 of the second reinforcing flange 21, both projecting from the second plate 6, are angled to match the chamfered outer corners 36 of the second plate 6.

Figures 4A, 4B, 4C:
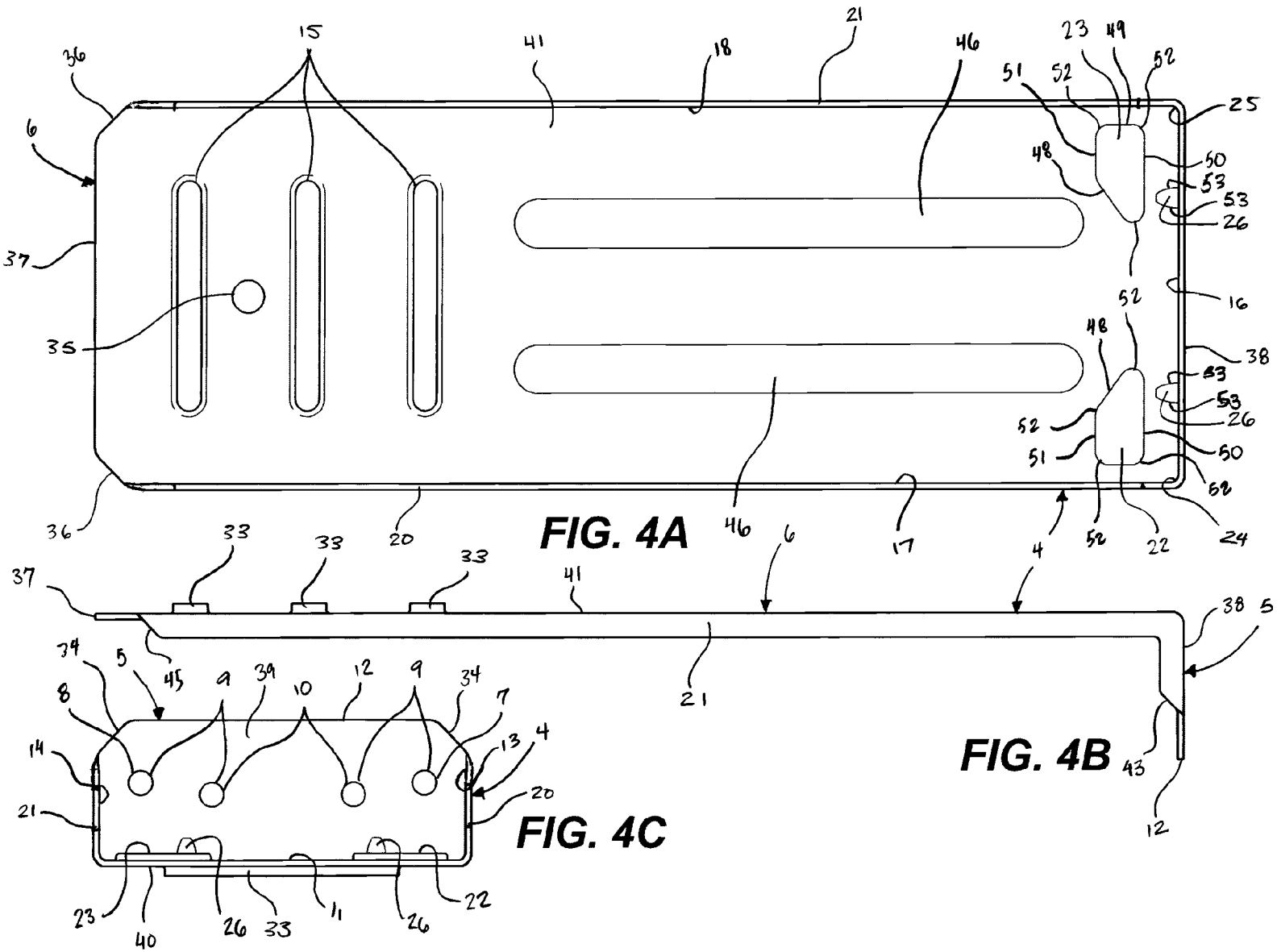
FIG. 4A is a front elevation view of a connector formed according to the present invention.
FIG. 4B is a side elevation view of a connector formed according to the present invention.
FIG. 4C is a bottom plan view of a connector formed according to the present invention.

As shown in FIGS. 4A-4C, in another preferred embodiment the connector 4 is basically the same as shown in FIGS. 1A-3C, except that the second plate 6 is much longer from first inner edge 16 to first outer edge 37. The second plate 6 therefore has a third elongated slot opening 15 and a pair of elongated embossments 46 that run parallel to, and between, the first and second side edges 17 and 18, from the first and second trapezoidal embossments 22 and 23 almost to the nearest of the elongated slots openings 15. The elongated embossments 46 help to stiffen the longer second plate 6.

As shown in FIGS. 5A-7C, in a third preferred embodiment the orientation of the connector 4 is different and the second plate 6 projects down instead of to the side. In this case, the connector 4 is narrower, in order to fit within a first building structural member 2 that is a channel-shaped header 2. In this embodiment, there is only one additional fastener opening 10 between the first and second fastener openings 7 and 8 of the first plurality of fastener openings 9 in the first plate 5. This embodiment also demonstrates the reinforcing capacity of the rolled edges 33 of the elongated slot openings 15 in the second plate 6, since there are no first and second embossments 22 and 23 in the second plate 6. Because the elongated slot openings 15 are oriented longitudinally, parallel to the first and second side edges 17 and 18 of the second plate, the rolled edges 33 stiffen most of the second plate 6 between the first and second reinforcing flanges 20 and 21.

As shown in FIGS. 8A-10B, in fourth and fifth preferred embodiments the connector 4 is made with a second plurality of fastener openings 15 in the second plate 6 that are conventional round and triangular fastener openings 15, rather than elongated slot openings 15. Conventionally, round openings 15 denote those that must be filled to achieve normal load values; triangular openings 15 denote those that can be filled to achieve a maximum load value in excess of the normal load values. These embodiments are intended for applications where a slip, or slide, connection is not required.

As shown in FIGS. 11A-12D, in a sixth preferred embodiment the connector 4 is substantially wider and attaches to the top or bottom of the first building structural member 2 rather than to a side. This embodiment is used in particular where a wall post or stud 3 bypasses the supporting beam 2. In this embodiment there is a third reinforcing flange 47 attached to the first outer edge 37 of the second plate 6, running from the first outer chamfered corner 36 to the second outer chamfered corner 36. Instead of a staggered first plurality of fastener openings 9, the first plurality of fastener openings 9 is a line of fastener openings 9 running from the first side edge 13 of the first plate 5 to the second side edge 14 of the first plate 5. The second plate 6 is stiffened by two pairs of elongated embossments 46 that are centrally located. There are three parallel elongated slot openings 15 with rolled edges 33 at each end of the second plate 6, near the first side edge 16 and the second side edge 17 of the second plate 6, respectively.

As shown in FIGS. 1A-4C and 8A-10C, the first embossment 22 in the second plate 6 is preferably six material thicknesses from the first side edge 17 of the second second plate 6; the second embossment 23 in the second plate 6 is preferably six material thicknesses from the second side edge 18 of the second plate 6.

Preferably, the first embossment 22 in the second plate 6 is generally trapezoidal, with a first diagonal edge 48 that generally leads toward the gusset dart 26 closest to the first side edge 17 of the second plate 6; preferably, the second embossment 23 in the second plate 6 is generally trapezoidal, with a first diagonal edge 48 that generally leads toward the gusset dart 26 closest to the second side edge 18 of the second plate 6. The diagonal edges 42 and 43 funnel load toward the gusset darts 26 and the inner additional fastener openings 10 in the first plate 5. Load is funneled inward and away from the first and second reinforcing flanges 20 and 21 in order to distribute load to the inner additional fastener openings 10 of the first plurality of fastener openings 9. In general, load is predominantly resisted where the connector 4 is stiffest, and the first and second embossments 22 and 23, in combination with the gusset darts 26, stiffen the connector 4 so that load is more evenly distributed among the first plurality of fastener openings in the first plate 5.

The first and second embossments 22 and 23 in the first plate 6 are preferably embossed to a depth of one material thickness, most preferably 0.057 inches. A greater embossment depth than two material thicknesses would exceed the sheet metal's ability to stretch without fracturing.

Most preferably, the first and second embossments 22 and 23 in the first plate 6 minor each other. Each has a first vertical edge 49 parallel to the first and second side edges 17 and 18 of the second plate 6. In the preferred embodiments shown in FIGS. 1A-4C, in which the first and second plates 5 and 6 are four inches wide, the first vertical edge 49 of the first embossment 22 faces, and is 0.25 inches away from, the first side edge 17 of the second plate. The first vertical edge 49 of the second embossment 23 faces, and is 0.25 inches away from, the second side edge 18 of the second plate. The first and second embossments 22 and 23 extend an additional 0.938 inches away from the first and second side edges 17 and 18, respectively. Each of the first and second embossments 22 and 23 has a first horizontal edge 50 that is orthogonal to the first vertical edge 49 and parallel to the first inner edge 16 of the first plate 6. The first horizontal edges 44 of the first and second embossments 22 and 23 face, and are 0.375 inches away from, the first inner edge 16 of the first plate 6. Each of the first and second embossments 22 and 23 has a second horizontal edge 51 further away from the first inner edge 16 of the first plate 6, parallel to the first horizontal edge 50, and 0.5 inches away from the first horizontal edge 50. The second horizontal edges 45 are shorter than the first horizontal edges 44. First diagonal edges 42 join the first horizontal edges 44 to the second horizontal edges 45; the angle between the first diagonal edges 42 and the first horizontal edges is 35 degrees. The edges 42-45 of the first and second embossments 22 and 23 meet at rounded corners 52 with 0.125-inch radii.

Preferably, the fastener openings 9 of the first plurality of fastener openings 9 in the first plate 5 are round and match the size of the first plurality of fasteners 27. Exact positioning of the first plurality of fasteners 27 is necessary in order to correctly calculate the loads distributed among the first plurality of fasteners 27. Furthermore, if the fastener openings 9 of the first plurality of fastener openings 9 were oversized or slotted, the material of the first plate 5 would be more likely to tear around the fasteners 27 of the first plurality of fasteners 27, reducing maximum achievable loads. Furthermore, the removing additional material from the first plate 5 would reduce the first plate 5 and weaken the connection 1.

As shown in FIGS. 1A-10C, in the preferred embodiments in which the first plate is four inches wide, the first fastener opening 7 of the first plurality of fastener openings 9 is preferably 0.5 inches on center from the first side edge 13 of the first plate 5. The second fastener opening 8 of the first plurality of fastener openings 9 is preferably 0.5 inches on center from the second side edge 14 of the first plate 5. If there is only one additional fastener opening 10 in the first plate 5, as shown in FIGS. 5A-7C, it is preferably spaced 1.625 inches on center from both the first side edge 13 and the second side edge 14. If there are multiple additional fastener openings 10, one is 1.25 inches on center from the first side edge 13 and one is 1.25 inches on center from the second side edge 14. If there are two additional fastener openings 10, as shown in FIGS. 1A-4C and 8A-10C, they are 1.5 inches on center from each other. The first and second fastener openings 7 and 8 preferably are 0.625 inches on center from the first outer edge 12 of the first plate 6. The additional fastener openings 10 preferably are 0.75 inches from the first outer edge 12 of the first plate 6. The round fastener openings 9 of the first plurality of fastener openings are preferably 0.216 inches in diameter. The round fastener openings 15 of the second plurality of fastener openings are preferably 0.190 inches in diameter.

Figure 8C:
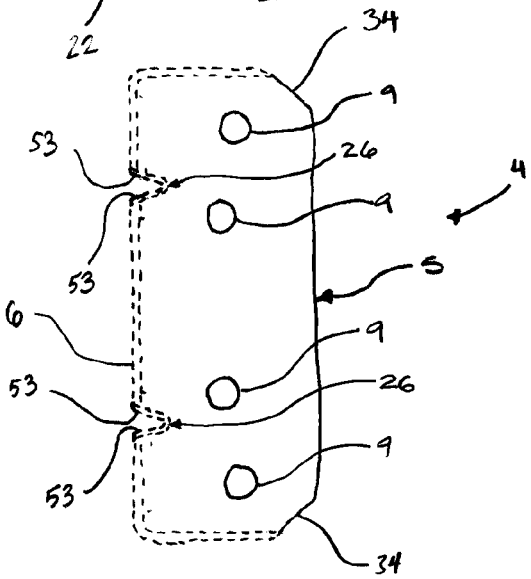
FIG. 8C is a top plan cross-sectional cutaway view taken along view line 8C-8C of the connector shown in FIG. 8B.
Figure 9A:
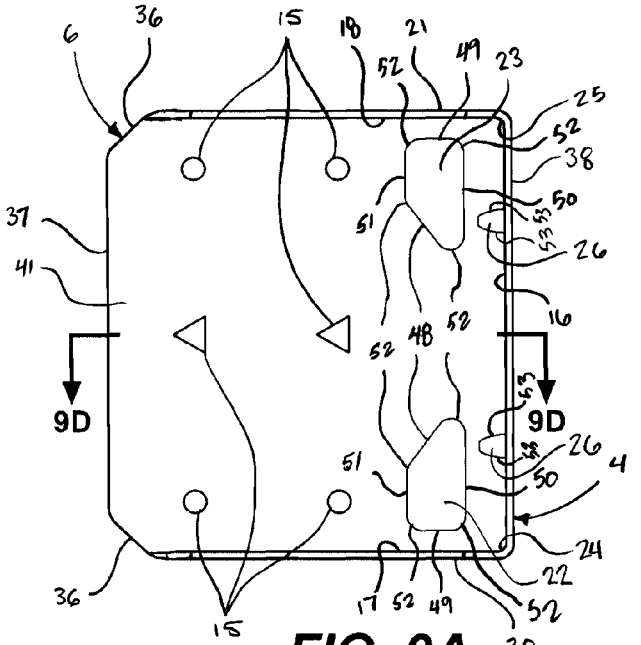
FIG. 9A is a front elevation view of a connector formed according to the present invention.
Figure 9C:
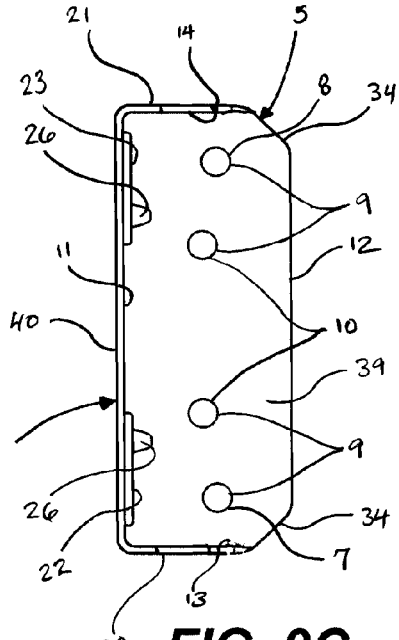
FIG. 9C is a top plan view of a connector formed according to the present invention.
Figure 9B:
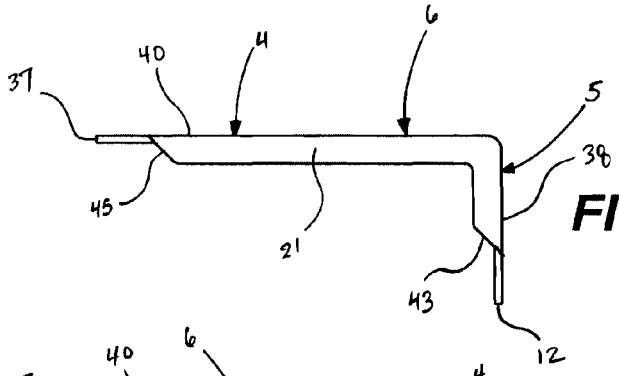
FIG. 9B is a side elevation view of a connector formed according to the present invention.
Figure 9D:
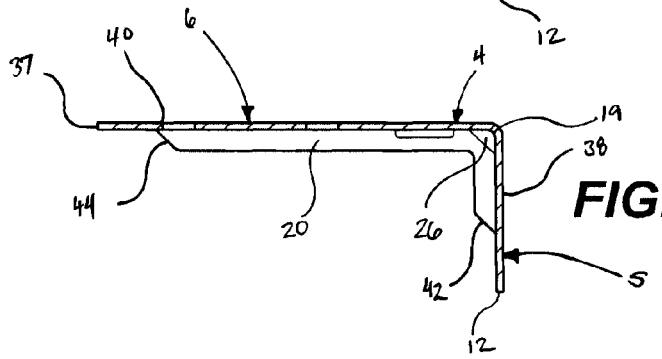
FIG. 9D is a side elevation cross-sectional cutaway view taken along 9D-9D of FIG. 9A of a connector formed according to the present invention.
Figures 10A, 10B, 10C:
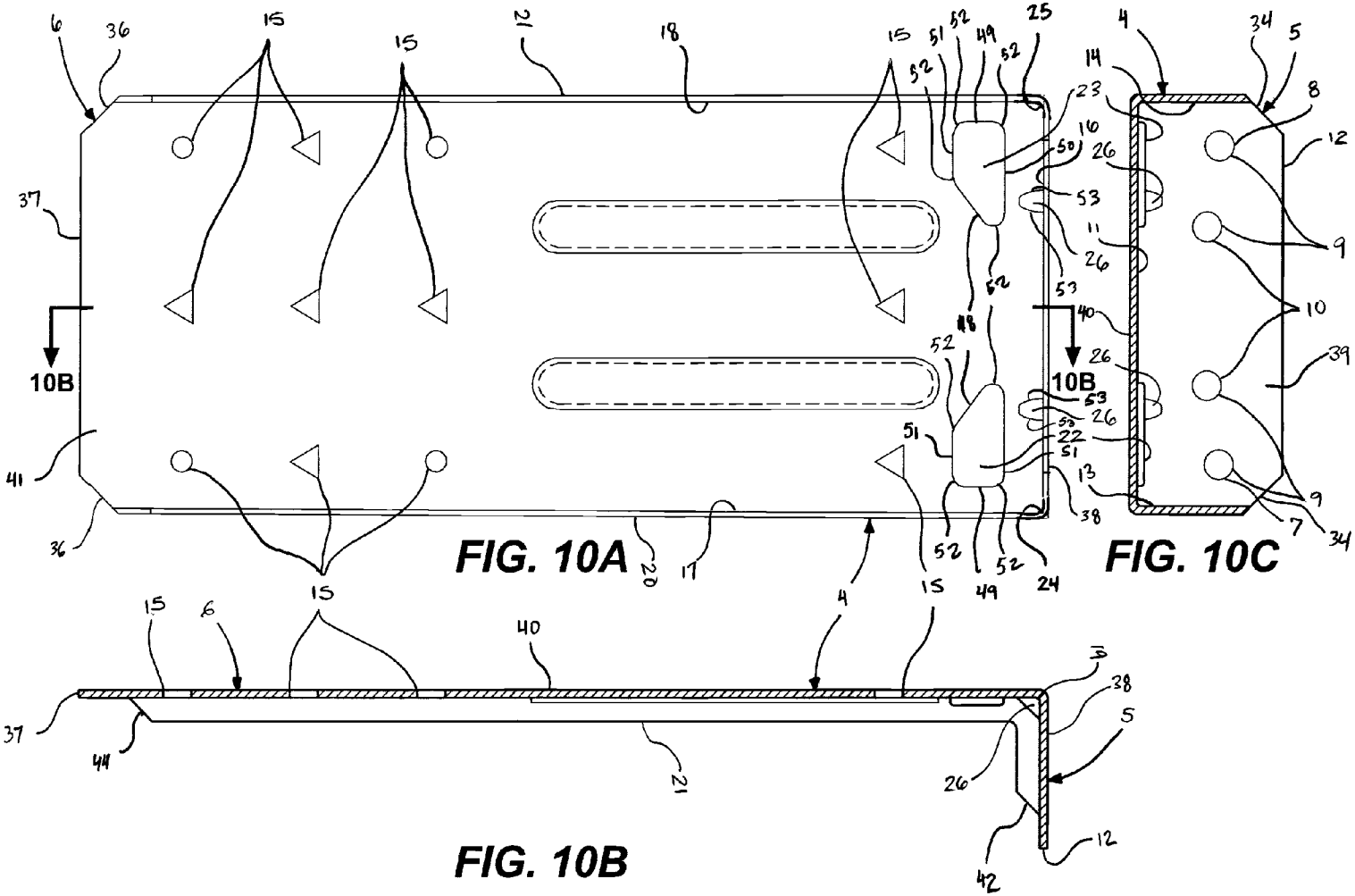
FIG. 10A is a front elevation view of a connector formed according to the present invention.
FIG. 10B is a side elevation cross-sectional cutaway view of a connector formed according to the present invention.
FIG. 10C is a top plan view of a connector formed according to the present invention.

As shown in FIGS. 1A-4C and 8A-10C, the gusset darts 26 are preferably embossed to a maximum height of 0.125 inches, each with two sides 53 defining an inner angle of 80 degrees, as shown in FIG. 8C. Preferably, there are two gusset darts 26, one spaced 1 inch on center from the first corner juncture 24 in the second plate 6, and one spaced 1 inch on center from the second corner juncture 25 in the second plate 6.

As shown in FIGS. 1A-1B, 3C, 4C, 8A-8B, 9C, 10A and 10C, the first embossment 22 preferably extends further from the first side edge 17 of the second plate 6 than the first fastener opening 7 is spaced from the first side edge 13 of the first plate 5. The second embossment 23 extends further from the second side edge 18 of the second plate 6 than the second fastener opening 8 is spaced from the second side edge 14 of the first plate 5. A first of the gusset darts 26 extends further from the first corner juncture 24 in the second plate 6 than the first fastener opening 7 is spaced from the first side edge 13 of the first plate 5. And a second of the gusset darts 26 extends further from the second corner juncture 25 in the second plate 6 than the second fastener opening 8 is spaced from the second side edge 14 of the first plate 5.

Preferably, as shown in FIGS. 1A-7C and 11-12D, the fastener openings 15 of the second plurality of fastener openings 15 in the second plate 6 are slots 15 that are 0.25 inches wide and 2.375 inches long. Preferably, the rolled edges 33 of the second plurality of fastener openings 15 are 0.083 inches tall. The fastener openings 15 of the second plurality of fastener openings 15 are mutually spaced 1.25 inches on center.

Preferably, as shown in FIGS. 1A-10C, the first and second reinforcing flanges 20 and 21 are 0.25 inches tall from the first and second side edges 17 and 18, respectively, of the second plate 6, and from the first and second side edges 13 and 14, respectively, of the first plate 5.

As shown in FIGS. 1A-4C and 8A-10C, the connector 4 is preferably 4 inches wide from the first reinforcing flange 20 to the second reinforcing flange 21, inclusive. As shown in FIGS. 5A-7C, the connector 4 is preferably 3.25 inches wide from the first reinforcing flange 20 to the second reinforcing flange 21, inclusive. As shown in FIGS. 1A-10C, the first plate 5 measures 1.5 inches from the first inner edge 11 to the first outer edge 12. The length of the second plate 6 varies according to the distance between, and the size of, the first and second building structural member 2 and 3.

We claim:

1. A first building structural connection comprising:

a. a first building structural member;

b. a second building structural member;

c. a first sheet metal connector, said first connector comprising:

i. a first plate fastened to said first building structural member; and ii. a second plate fastened to said second building structural member, wherein:

(a) said first plate has first and second fastener openings of a first plurality of fastener openings that includes one or more additional fastener openings in addition to said first and second fastener openings, a first inner edge, a first outer edge, a first side edge and a second side edge, said first fastener opening being the closest of said first plurality of fastener openings to said first side edge, said second fastener opening being the closest of said first plurality of fastener openings to said second side edge, said first and second fastener openings being closer to said first outer edge than said one or more additional fastener openings, said one or more additional fastener openings being closer to said first inner edge than said first and second fastener openings;

(b) said second plate has a second plurality of fastener openings, a first inner edge, a first side edge and a second side edge, said first side edge of said second plate intersecting said first inner edge at a first corner juncture, said second side edge of said second plate intersecting said first inner edge at a second corner juncture;

(c) said first inner edge of said first plate is joined to said second inner edge of said second plate to form an inner angular juncture;

(d) a first reinforcing flange is attached to said first side edge of said first plate and to said first side edge of said second plate;

(e) a second reinforcing flange is attached to said second side edge of said first plate and to said second side edge of said second plate;

(f) a first embossment in said second plate, located between said second plurality of fastener openings and said first inner edge of said second plate, reinforces said second plate and is adjacent said first corner juncture; and (g) a second embossment in said second plate, located between said second plurality of fastener openings and said first inner edge of said second plate, reinforces said second plate and is adjacent said second corner juncture.

2. The building structural connection of claim 1 further comprising one or more gusset darts in said inner angular juncture that reinforces said inner angular juncture.

3. The building structural connection of claim 2 wherein:

a. said first embossment extends further from said first side edge of said second plate than said first fastener opening is spaced from said first side edge of said first plate, and the first embossment does not extend beyond any of the second plurality of fastener openings to be closer to the first outer edge of the second plate than any of the second plurality of fastener openings;

b. said second embossment extends further from said second side edge of said second plate than said second fastener opening is spaced from said second side edge of said first plate, and the second embossment does not extend beyond any of the second plurality of fastener openings to be closer to the first outer edge of the second plate than any of the second plurality of fastener openings;

c. a first of said gusset darts extends further from said first corner juncture in said second plate than said first fastener opening is spaced from said first side edge of said first plate; and d. a second of said gusset darts extends further from said second corner juncture in said second plate than said second fastener opening is spaced from said second side edge of said first plate.

4. The building structural connection of claim 1 further comprising:

a. a first plurality of fasteners that attach said first plate to said first building structural member; and b. a second plurality of fasteners that attach said second plate to said second building structural member.

5. The building structural connection of claim 4 wherein said fasteners of said second plurality of fasteners are screws.

6. The building structural connection of claim 5 wherein said second plurality of fastener openings is formed as a plurality of elongated slots in said second plate.

7. The building structural connection of claim 6 wherein said first building structural member is fastened to said first connector so that said first building structural member cannot move relative said first plate of said first connector.

8. The building structural connection of claim 7 wherein said second building structural member is fastened to said first connector so that said second building structural member can move relative said second plate of said first connector.

9. The building structural connection of claim 6 wherein said fasteners of said second plurality of fasteners are shouldered screws.

10. The building structural connection of claim 6 wherein said elongated slots have rolled edges that stiffen said elongated slots and reinforce said second plate.

11. The building structural connection of claim 10 wherein:

a. said first and second fastener openings of said first plurality of fastener openings are spaced 0.5 inches on center from said first and second side edges, respectively, of said first plate;

b. said first plate includes two additional fastener openings, one spaced 1.25 inches on center from said first side edge, and one spaced 1.25 inches on center from said second side edge;

c. said first and second reinforcing flanges each extend orthogonally 0.25 inches up from said open sides of said first and second plates;

d. said rolled edges of said elongated slots each extend orthogonally 0.083 inches down from said attachment side of said second plate;

e. said gusset darts each extend 0.125 inches up from said inner angular juncture, each having two sides defining an inner angle of 80 degrees;

f. one of said gusset darts is spaced one inch on center from said first corner juncture in said second plate, and one of said gusset darts is spaced 1 inch on center from said second corner juncture in said second plate;

g. said first and second fastener openings are spaced 0.625 inches on center from said first outer edge of said first plate, and said additional fastener openings are spaced 0.75 inches from said first outer edge of said first plate.

12. A first building structural connection comprising:

a. a first building structural member;

b. a second building structural member;

c. a first sheet metal connector, said first connector comprising:

i. a first plate fastened to said first building structural member; and ii. a second plate fastened to said second building structural member, wherein:

(a) said first plate has a first inner edge, a first outer edge, a first side edge and a second side edge;

(b) said second plate has a plurality of fastener openings, a first inner edge, a first side edge and a second side edge, said plurality of fastener openings is formed as a plurality of elongated slots in said second plate, and said elongated slots have rolled edges that stiffen said elongated slots and reinforce said second plate;

(c) said first inner edge of said first plate is joined to said second inner edge of said second plate to form an inner angular juncture; and (d) at least one fastener passing through at least one of said plurality of fastener openings in said second plate.

13. The building structural connection of claim 12 wherein:

a. a first reinforcing flange is attached to said first side edge of said first plate and to said first side edge of said second plate;

b. a second reinforcing flange is attached to said second side edge of said first plate and to said second side edge of said second plate.

14. The building structural connection of claim 13 further comprising one or more gusset darts in said inner angular juncture that reinforces said inner angular juncture.

15. The building structural connection of claim 14 further comprising:

a. a first plurality of fasteners that attach said first plate to said first building structural member; and b. a second plurality of fasteners that attach said second plate to said second building structural member.

16. The building structural connection of claim 15 wherein said fasteners of said second plurality of fasteners are screws.

17. The building structural connection of claim 16 wherein said first building structural member is fastened to said first connector so that said first building structural member cannot move relative said first plate of said first connector.

18. The building structural connection of claim 17 wherein said second building structural member is fastened to said first connector so that said second building structural member can move relative said second plate of said first connector.

19. The building structural connection of claim 16 wherein said fasteners of said second plurality of fasteners are shouldered screws.

20. The building structural connection of claim 13 wherein:

a. said first plate has first and second fastener openings of a first plurality of fastener openings that includes one or more additional fastener openings in addition to said first and second fastener openings, said first fastener opening being the closest of said first plurality of fastener openings to said first side edge, said second fastener opening being the closest of said first plurality of fastener openings to said second side edge, said first and second fastener openings being closer to said first outer edge than said one or more additional fastener openings, said one or more additional fastener openings being closer to said first inner edge than said first and second fastener openings.

21. The building structural connection of claim 13 further comprising:

a. a first embossment in said second plate, located between said second plurality of fastener openings and said first inner edge of said second plate, reinforces said second plate and is adjacent said first corner juncture; and b. a second embossment in said second plate, located between said second plurality of fastener openings and said first inner edge of said second plate, reinforces said second plate and is adjacent said second corner juncture.

22. The building structural connection of claim 21 wherein:

a. said first embossment extends further from said first side edge of said second plate than said first fastener opening is spaced from said first side edge of said first plate, and the first embossment does not extend beyond any of the second plurality of fastener openings to be closer to the first outer edge of the second plate than any of the second plurality of fastener openings;

b. said second embossment extends further from said second side edge of said second plate than said second fastener opening is spaced from said second side edge of said first plate, and the second embossment does not extend beyond any of the second plurality of fastener openings to be closer to the first outer edge of the second plate than any of the second plurality of fastener openings;

c. a first of said gusset darts extends further from said first corner juncture in said second plate than said first fastener opening is spaced from said first side edge of said first plate; and d. a second of said gusset darts extends further from said second corner juncture in said second plate than said second fastener opening is spaced from said second side edge of said first plate.

* * * * *